United States Patent [19]

Shannon

[11] 4,006,840

[45] Feb. 8, 1977

[54] BEVERAGE DISPENSER HAVING FLOW-ACTUATED SENSING MEANS

[75] Inventor: Joseph W. Shannon, Kent, Ohio

[73] Assignee: American Beverage Control, Kent, Ohio

[22] Filed: July 7, 1975

[21] Appl. No.: 593,847

[52] U.S. Cl. ..... 222/30; 222/70; 235/92 FL

[51] Int. Cl.[2] ..... B67D 5/54

[58] Field of Search ..... 222/23, 36, 37, 70, 222/71, 30; 200/84 C, 82 E, 81.9 M; 58/145 R; 235/92 FL

[56] References Cited

UNITED STATES PATENTS

| | | | |
|---|---|---|---|
| 2,963,563 | 12/1960 | Patterson | 200/81.9 M |
| 3,446,986 | 5/1969 | Cox | 200/82 E X |
| 3,467,279 | 9/1969 | Upton et al. | 222/70 X |
| 3,665,167 | 5/1972 | Goodwin | 235/92 FL |
| 3,699,315 | 10/1972 | Upton | 222/23 X |

*Primary Examiner*—Robert R. Reeves
*Assistant Examiner*—Joseph J. Rolla
*Attorney, Agent, or Firm*—Oldham & Oldham Co.

[57] ABSTRACT

A beverage dispenser having a flow-actuated sensing member positioned within a dispensing line thereof and which is operative to sense and record the dispensing of preselected volumes of a beverage. Fundamentally, the invention includes a switch positioned within the flow line and actuated by the flow of the beverage to enable timing circuits which determine the volume of beverage dispensed based upon the time of dispensing. Actual control of the timing and recording circuitry is achieved by sensing of the beverage flow rather than by operator-actuated elements.

9 Claims, 3 Drawing Figures

BEVERAGE DISPENSER HAVING FLOW-ACTUATED SENSING MEANS

BACKGROUND OF THE INVENTION

Heretofore numerous approaches have been taken to solve the problem of inventory control with respect to the dispensing of beverages. More particularly, bars, taverns, fast-food restaurants and the like have been confronted with the problem of maximizing profits by reducing waste and pilferage due to the lack of reliable monitoring devices associated with the beverage dispensing apparatus. Various techniques and apparatus have been proposed to alleviate these problems, but all known approaches have had drawbacks of such nature as to render the systems undesirable.

Certain approaches toward monitoring devices teaching the inclusion of a light sensor positioned along the flow path. However, such light has been found to be harmful to beer, wine, champagne and the like and hence such systems may not be utilized for apparatus used in the dispensing of such beverages. Similarly, many monitoring devices generate heat which again has a tendency to degrade the quality of the beverage. Still other systems which have been proposed place a mechanical restriction within the fluid passageway which interrupts the fluid flow and causes a turbulence which is detrimental to the character of the beverage being dispensed. Yet other approaches have included programmed control devices which are affected by the temperature and atmospheric pressure at which the beer or wine is dispensed. Yet further, known systems completely disallow dispensing in the event of power failure.

Consequently, it is an object of the instant invention to present a beverage dispenser wherein the volume sensing means are not harmful to the beverage being dispensed in that there is no utilization of light-emitting or heat-creating sensors.

It is a further object of the invention to present a beverage dispensing device wherein there is no change made in the fluid passageway by the enabling and actuation of the sensing means.

Still a further object of the invention is to provide a beverage dispensing device wherein the flow of the beverage is not controlled by the device but is controlled by the operator such that unstable liquids such as beer and wine may be dispensed without being affected by temperature, pressure, and the like.

Still a further object of the invention is to present a beverage dispensing device which is inexpensive to construct, reliable in operation, readily constructed with state of the art elements, and easily adapted for inclusion with presently existing systems.

These objects and other objects which will become apparent as the detailed description proceeds are achieved by a beverage dispenser apparatus for monitoring the volume of beverage dispensed from a mass reservoir through a dispensing line and out a pouring head, comprising: means for actuating the flow of beverage from the mass reservoir and through the dispensing line; switch means operatively engaged with the dispensing line and actuated by the flow of said beverage; timing means connected to and actuated by the switch means for timing a period of flow of the beverage through the dispensing line and determining the number of preselected volumes of such beverage dispensed based on the period of flow; and recording means connected to the timing means for recording the number of preselected volumes dispensed.

DESCRIPTION OF THE DRAWINGS

For a complete understanding of the objects, techniques, and structure of the invention, reference should be had to the following detailed description and accompanying drawings wherein.

DETAILED DESCRIPTION OF PREFERRED EMBODIMENT

Figure 1:
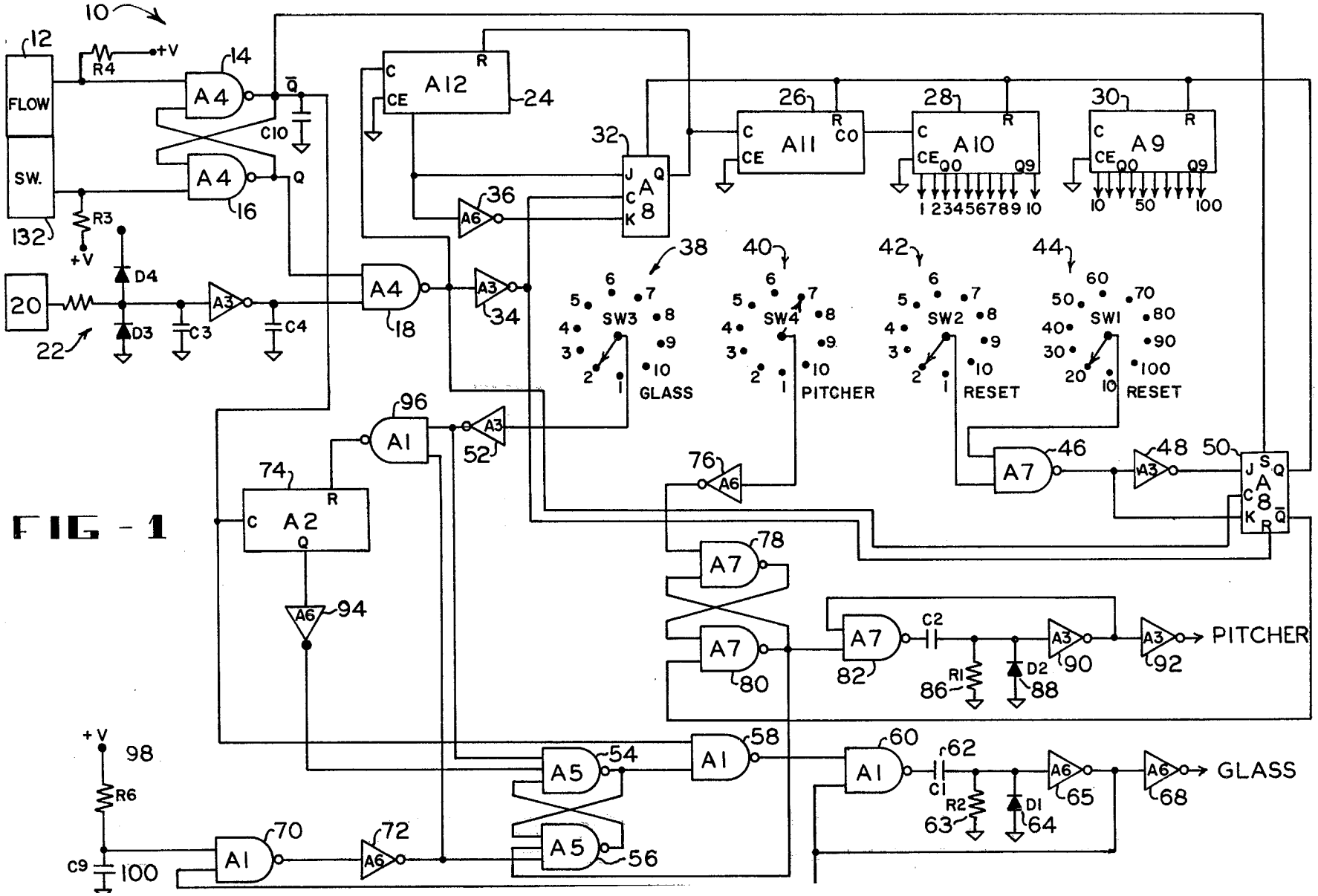
FIG. 1 is a schematic diagram of the timing counter circuitry of the invention.

Referring now to the drawings and more particularly FIG. 1, an understanding of the structure of the invention may be achieved. The timing counter circuit, designated generally by the numeral 10, is actuated by a flow switch 12 which will be discussed in detail hereinafter. Suffice it to say that the flow switch 12 is actuated by the actual flow of beverage, for example beer, through the dispensing line. Such flow is itself controlled by a standard tap valve or other appropriate valve means which is enabled and operated by the bartender or other personnel to deliver the beverage from a mass reservoir to the dispensing head. As the beer or other beverage begins to flow through the line and actuates the flow switch 12, the latch comprising nand gates 14, 16 is set, thus enabling nand gate 18 to pass a 60 hz signal from a low voltage transformer 20 through a clipping and squaring circuit 22 and then to the decode circuitry 24–30. The divide by 6 decoder 24 enables the JK flip-flop 32 to pulse the divide by 10 decoder 26 on every sixth pulse output of the nand gate 18. Thus, the output of the divide by 10 decoder 26 is a 1 hz signal. Of course, the inverters 34, 36 function in the normal fashion. The decoders 28 and 30 respectively count from 0 to 9 seconds in 1 second increments and from 0 to 90 seconds in 10 second increments.

As can be seen, four rotary selection switches 38–44 are provided for purposes of selecting the various time functions being associated with the dispensing operation. Switch 38 may be set at the maximum time allowed for adding a head to a glass or pitcher of beer; switch 40 may be set to that period of time which is the maximum time required for dispensing a first volume or glass of beer; and switches 42 and 44 are set to designate the maximum period of time required to pour or dispense a second volume or pitcher of beer. Of course, the contacts of the switches 38–44 are connected to the proper decode outputs of the one of ten decoders 28 and 30. It should now be readily apparent that when the maximum time for dispensing a pitcher of beer is achieved, the outputs of the decoders 28, 30, passing through the respective switches 42, 44 are active through nand gate 46 and inverter 48 to set the flip flop 50 and hence reset the decoders 24–30 to prepare them for subsequent dispensing.

As will be understood by those skilled in the art, when a dispensing cycle has been initiated and the time of such dispensing reaches that selected by switch 38, a signal passing through inverter 52 is operative to set the latch 54, 56 thus enabling nand gate 58. If the dispensing cycle is terminated while the latch 54, 56 is set, the latch comprising nand gates 14, 16 resets, passing a signal through the nand gate 58 and to the one shot comprising nand gate 60, RC circuit 62, 63, diode 64, and the inverter 65. For polarity purposes, an output inverter 68 is provided. The signal output from inverter 68 indicates that a glass has been dispensed and that the dispensing cycle has been terminated. A feed back from the inverter 65 to the nand gate 70 and inverter 72 is operative to reset the latch 54, 56 and decoder 74 to be discussed hereinafter.

Consider now the dispensing of a pitcher of beer or other beverage. When the maximum time required for dispensing a glass of beer or the like has been exceeded as indicated by the output of the selector switch 40, a signal passing through the inverter 76 is operative to set the latch 78, 80 which fires a one shot similar to that just described comprising nand gate 82, RC circuit 84, 86, diode 88 and inverter 90. Again, for purposes of polarity correction an output inverter 92 is provided. Each firing of the one shot 82–90 indicates the dispensing of a pitcher; that time being in excess of the maximum time required for dispensing a glass. When the maximum time required for dispensing a pitcher is reached, the flip flop 50 is reset via the outputs of selector switches 42, 44 thus resetting the decoders 24—30 and the latch 78, 80. After such resetting, and if the dispensing cycle is continuing, another pitcher is counted in the manner aforementioned after the maximum time required for dispensing a glass has again been reached. This cycle continues until the dispensing cycle is terminated.

Unique provisions are made in accordance with the teachings of this invention for the unrecorded addition of a head onto either a glass or pitcher of beer after the same has been dispensed. As can be seen, upon each actuation of the flow switch, the latch 14, 16 passes a clock pulse to the decoder 74. After three separate actuations, the decoder produces an output through the inverter 94 thus latching the glass-indicating latch 54, 56 and producing a signal indicating that a glass has been dispensed. It should be noted that such indication occurs even though none of the three dispensing cycles was of a time duration sufficient to indicate via switch 38 that a glass had been dispensed. Consequently, with the decoder 74 connected as shown, two heads may be added to a glass or pitcher of beer without the same being recorded as a dispensing cycle. Of course, the decode 74 could be connected so as to allow any number of unrecorded heads. When the next glass of beer is dispensed and a signal emitted via switch 38 through inverter 52 and nand gate 96, the decoder 74 is reset such that another two unrecorded heads may be added. It should, of course, be remembered that a glass is defined as a dispensing of time duration greater than the maximum allowable head dispensing and less than some maximum time of dispensing.

Before leaving FIG. 1, it should also be noted that a power-on preset is provided via nand gate 70 and its interconnection between resistor 98 and capacitor 100 interconnected between the plus voltage supply and ground. When the system is initially turned on and power applied, this circuit provides for the resetting of the latches and decoders in the normal fashion.

Figures 2, 3:
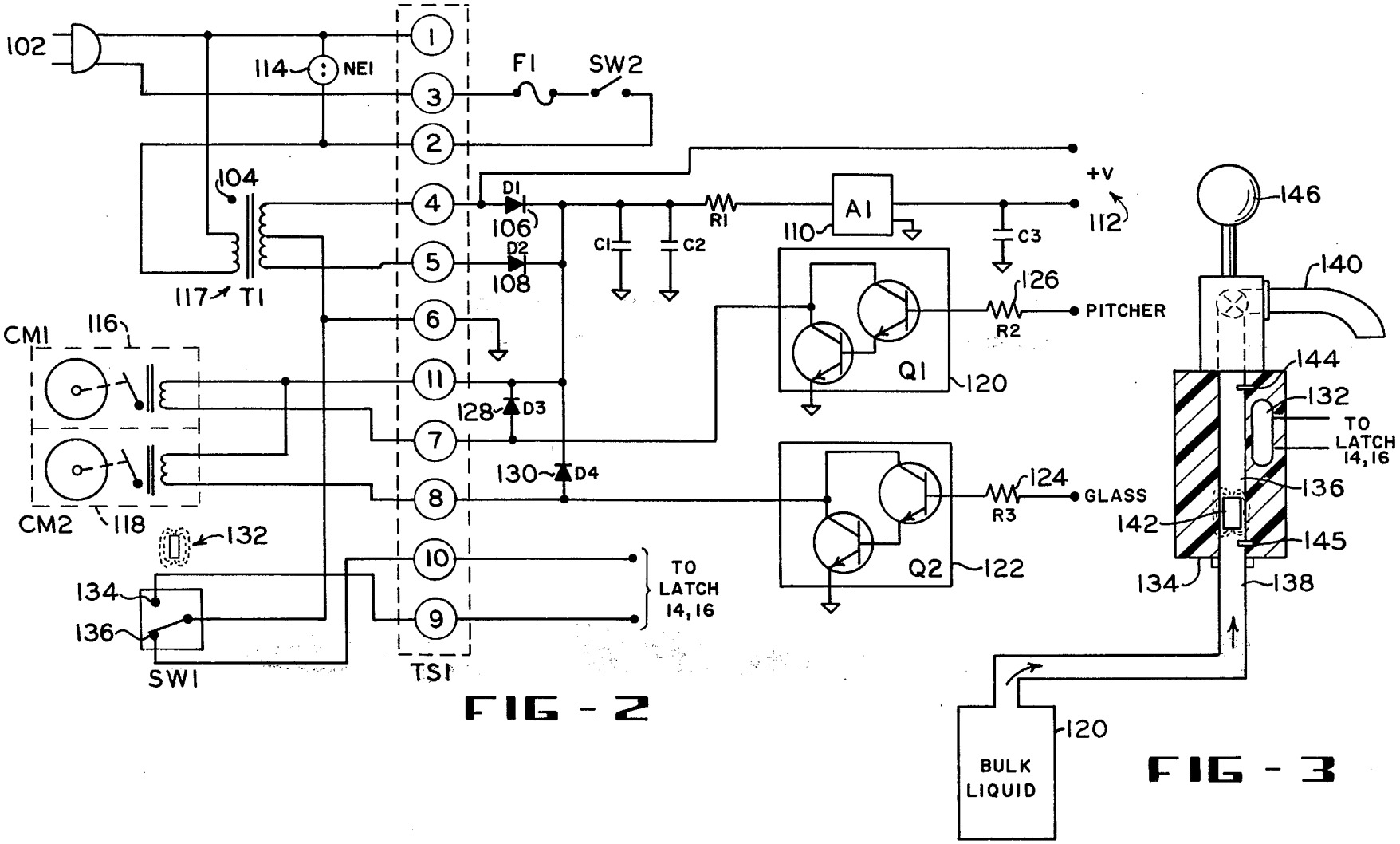
FIG. 2 is a schematic diagram of the power control circuitry of the invention.
FIG. 3 is a sectional view of the timing circuit actuation means provided in conjunction with the beverage flow line.

Referring now to FIG. 2, an understanding of the power control circuitry of the invention may be had. As can be seen, the line voltage 102 is applied to the center tap transformer 104 and thence to the full wave bridge comprising diodes 106, 108 before application to a low voltage regulator 110. The output 112 of the voltage regulator 110 is used to supply the voltage as necessary for operation of the logic circuitry of the invention. The neon bulb 114 is provided to indicate that the system is energized and appropriate smoothing and decoupling capacitors are provided in the normal manner.

Counters 116, 118 are provided for respectively recording the dispensing of first and second volumes, for example a pitcher and glass, of beverage. These counters are preferably electro-mechanical non-resettable counters which are respectively driven by the Darlington circuits 120, 122. The circuit 122 is actuated by the output signal from the inverter 68 through the resistor 124; this signal indicating that a glass of the beverage has been dispensed. Similarly, the circuit 120 is actuated by the output of the inverter 92 through the resistor 126; this signal indicating that a pitcher has been dispensed. These Darlingtons actuate associated counters which are driven by power from the common point of the bridge circuit 106, 108. Diodes 128, 130 are provided for slipping the inductive spikes from the coils of the counters 116, 118. It should be readily appreciated then that signals from the inverters 68 and 92 actuate the associated counters 118, 116 for purposes of making a permanent record of the beverage dispensed.

A flow switch 132, which provides the input signals to the latch 14, 16 of FIG. 1 is shown in schematic form in FIG. 2. Suffice it to say at this point that the switching element of the reed switch 132 is connected to ground and is operative in either of two positions, designated by contacts 134 and 136, to exclusively pull down an input to one of the nand gates 14, 16 to set or reset the latch.

Referring to FIG. 3, the mechanical structure of the flow switch 132 may be seen. The switch comprises basically a housing 134 with a cylindrical channel 136 passing therethrough. Threadedly engaged at one end of the channel 136 is the beverage input line 138 which is connected in fluid passing relationship with a keg or bulk reservoir 120 holding the beer or other liquid to be dispensed. Preferably, the bulk reservoir 120 is pressurized as is standard in the art. At the other end of the channel 136 there is threadedly connected an output nozzle 140 communicating with the dispensing head under which the pitcher, glass, or other receptacle may be placed for receiving the beverage dispensed.

Received within the channel 136 is a magnetic element or permanent magnet 142 which is preferably incased by a Teflon$^R$ or other plastic coating. The magnet 142 is free to travel within the channel 136 between the stop pins 144, 145. The operator or bartender's manual opening of the standard tap valve 146 allows the beverage to pass through the input line 138, the channel 136, and the output nozzle 140. This flow causes the incased magnet 142 to ride upward into contacting engagement with the pin 144. The reed switch 132 is thus actuated by the presence of the magnet and the actuation of the same sets the latch 14, 16 as discussed hereinabove. Preferably, the housing 134 is molded to receive and incase the read switch 132 and pins 144, 145 so as to comprise a single unit.

It should now be readily apparent that a structure has been presented whereby fluid flow may be controlled by an operator, while the duration of such flow is monitored by automatic means. While in accordance with the patent statutes only the best mode and preferred embodiment of the invention has been presented and described in detail, it is to be understood that the invention is not limited thereto or thereby. Consequently, for an appreciation of the scope and breadth of the invention, reference should be had to the following claims.

What is claimed is:

1. A beverage dispenser apparatus for monitoring the volume of beverage dispensed from a mass reservoir through a dispensing line and out a pouring head, comprising:

valve means for permitting the flow of beverage from the mass reservoir and through the dispensing line;

switch means operatively engaged with the dispensing line and actuated by the flow of said beverage;

a counting circuit connected to and actuated by said switch means;

decode means connected to said counting circuit for producing output signals at selected time intervals after the actuation of said switch means, said time intervals corresponding with preselected volumes dispensed; and recording means connected to said decode means for recording the dispensing of a first preselected volume only after said flow of beverage through the dispensing line has terminated, recording the dispensing of a second preselected volume immediately upon receipt of an output signal from the counting circuit indicating that such second volume has been dispensed and being inhibited from recording the dispensing of third preselected volumes until a fixed number of said third preselected volumes have been dispensed, at which time said recording means records the dispensing of a volume equal said first preselected volume.

2. The beverage dispensing apparatus as recited in claim 1 wherein said decode means are programmable.

3. The beverage dispenser apparatus as recited in claim 1 wherein said valve means comprises a manually controlled tap valve.

4. The beverage dispenser apparatus as recited in claim 1 wherein said switch means includes an element movable within the dispensing line.

5. The beverage dispenser apparatus as recited in claim 4 wherein said switch means comprises a reed switch interposed adjacent said dispensing line and wherein said element is a magnetic element movable between two fixed limits within said dispensing line.

6. The beverage dispenser apparatus as recited in claim 5 wherein said reed switch is interposed adjacent said dispensing line at one of said fixed limits.

7. A device for monitoring the volume of a liquid dispensed from a container and through a dispensing line, comprising:

a manually controlled tap valve for permitting and inhibiting the flow of liquid through the line;

switch means positioned adjacent said line for actuation according to the flow of liquid through said line;

a element within said line movable between two limits via the flow of liquid and in communication with said switch means for activating the same;

a timing circuit including a counter connected to and activated by the switch means and a decoder connected to the counter and producing output signals at fixed time intervals after the activation of the switch means; and a recorder connected to the timing circuit, receiving said output signals, and recording the dispensing of particular volumes of liquid according to said signals, said recorder recording the dispensing of a first volume if flow terminates before a first period of time, recording the dispensing of a second volume if flow continues after said first period of time, recording nothing if flow terminates before a second period of time and recording the dispensing of said first volume if flow is activated and terminated a fixed each having a period of dispensing not number of times exceeding said second period of time.

8. The device as recited in claim 7 wherein said element is a magnetic element and wherein said switch means comprises a reed switch.

9. The device as recited in claim 7 wherein said decoder is programmable to regulate said time intervals.

* * * * *